United States Patent [19]

Gledhill et al.

[11] 3,952,431

[45] Apr. 27, 1976

[54] VEHICULAR CARRIED PLOW COUPLING

[75] Inventors: William Gledhill; Philip Leland Sherman, both of Galion, Ohio

[73] Assignee: Gledhill Road Machinery Company, Galion, Ohio

[22] Filed: May 29, 1975

[21] Appl. No.: 581,853

Related U.S. Application Data

[63] Continuation of Ser. No. 516,563, Oct. 21, 1974, abandoned, which is a continuation of Ser. No. 379,966, July 17, 1973, abandoned, which is a continuation-in-part of Ser. No. 211,076, Dec. 22, 1971, Pat. No. 3,746,368.

[52] U.S. Cl. ..... 37/41; 172/272; 280/504; 280/510

[51] Int. Cl.[2] ..... E01H 5/00

[58] Field of Search ..... 37/41, 42 R, 42 VL, 37/50, 117.5; 172/272–276; 280/504, 510, 488 R, 478 R, 481 R, 479 R; 214/145 A

[56] References Cited

UNITED STATES PATENTS

| | | | |
|---|---|---|---|
| 665,294 | 1/1901 | Williams | 280/510 X |
| 1,206,100 | 11/1916 | Fitzgerald | 280/510 X |
| 1,744,972 | 1/1930 | Kline | 280/510 X |
| 1,891,711 | 12/1932 | Himmelberger | 280/510 |
| 2,393,657 | 1/1946 | Rudnick | 280/510 X |
| 3,020,066 | 2/1962 | Torrey | 280/510 |
| 3,343,850 | 9/1967 | Stauss et al. | 37/41 X |
| 3,410,008 | 11/1968 | Standfuss | 37/42 R |
| 3,464,129 | 9/1969 | Bogenschutz | 37/50 |
| 3,605,906 | 9/1971 | Coates | 37/42 R X |
| 3,706,144 | 12/1972 | Miceli | 37/50 X |

*Primary Examiner*—E. H. Eickholt
*Attorney, Agent, or Firm*—Fay & Sharpe

[57] ABSTRACT

A coupling between a snow plow and the front of a truck including a housing assembly adapted to be mounted on the truck and a loop and frame member adapted to be mounted on the snow plow. The housing has a convex front surface and a recess in said surface defined by rearwardly converging walls. A hook means is mounted in said recess and is adapted to pivot about an axis between open and closed positions. Means are provided for locking the hook member in its closed position. A frame member is adapted to abut the convex surface on the forward face of the housing member and the loop projects rearwardly from the frame member into the recess where it is held in place by the hook means.

3 Claims, 9 Drawing Figures

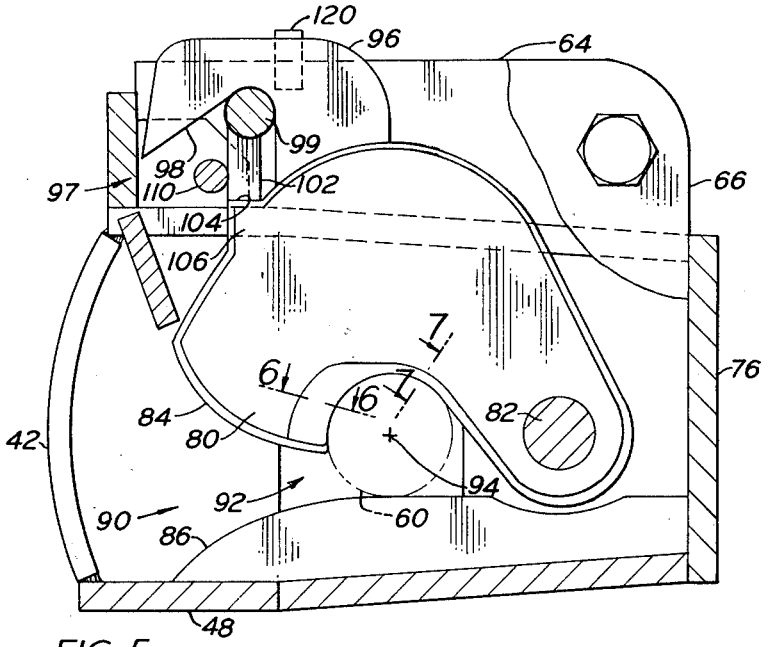
FIG. 5
FIG. 6
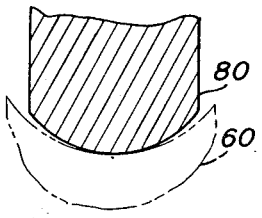
FIG. 7
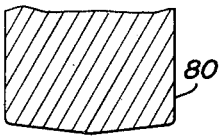

VEHICULAR CARRIED PLOW COUPLING

This application is a continuation of application Ser. No. 516,563, filed Oct. 21, 1974, now abandoned, which in turn is a continuation of application Ser. No. 379,966, filed July 17, 1973, now abandoned, which in turn is a continuation-in-part of application Ser. No. 211,076, filed Dec. 22, 1971, now U.S. Pat. No. 3,746,368.

BACKGROUND AND BRIEF DESCRIPTION OF THE INVENTION

The subject invention is directed toward the art of snow plow couplings, and, particularly, to an improved coupling especially suited for releasably connecting snow plows or the like to vehicles such as trucks. It will be clear to those having ordinary skill in the art that the subject couplings are adapted for other than snow plows but for convenience only snow plows will be discussed.

A primary object of the invention is the provision of a releasable coupling which, when being coupled to the plow, provides a slight resistance so that the driver of the truck knows when a positive engagement has been made.

The coupling of the subject invention is designed so that the plow can readily tilt to follow road contours and the crown while simultaneously permitting raising and lowering of the plow.

Many different types of prior art coupling arrangements have been used and all suffer from a variety of defects. For example, one common problem is that during a coupling operation, the driver of the vehicle is never sure exactly when a positive engagement has been made. The usual practice is to use two men for the coupling operation, one to drive the truck forward and one to signal and perform the other needed outside operations.

A second disadvantage of many prior art couplings is that they do not permit the plow blade to have free movement for both side tilting and the usual raising and lowering. Those couplings which do satisfy the above discussed points are generally extremely complex and relatively costly.

Broadly, the invention proposes a coupling including a housing assembly adapted to be mounted on a vehicle and a loop member adapted to be connected to a plow push bar. The housing includes a first force receiving surface having a curved contour across its width. A recess extends inwardly from the curved push surface, preferably said recess has tapered lateral side walls. A hook or latch member is positioned in the recess and is adapted to pivot about an axis generally horizontal and parallel to the push surface. A forwardly facing surface of the hook member is exposed in the recess and behind said forwardly facing surface is a downwardly facing recess contoured to encompass a portion of the loop member. A guide member is positioned beneath the hook in the recess and, in combination with the forwardly facing surface defines a guide mouth such that when the housing is moved toward the loop, the hook member is cammed upwardly. Additionally, there are means for locking said hook member in a down or closed position.

The invention contemplates that the locking means will comprise a cam face extending outwardly from the hook and engaged by a pivotally mounted plate movable between a first position in which it engages the hook and a second position wherein it engages the cam face.

Preferably, the loop member has a circular cross-section and the downwardly open surface of the hook member is similarly contoured. Additionally, the loop means preferably has a V-shaped configuration generally corresponding to the lateral sides of the recess. The relationship between the loop, the side walls of the recess, and the hook, are such that the loop can both tilt and rotate a substantial amount relative to the housing while it is locked in operative position by the hook.

Accordingly, a primary object of the invention is the provision of a relatively simple plow coupling which permits tilting and lifting of the plow while connected to the truck and which also provides the driver with an indication of when a positive coupling has taken place.

Yet another object of the invention is the provision of a coupling arrangement of the general type described wherein a positive lock of the coupling is provided by a simple lever operated lock plate.

The above and other objects and advantages will become apparent from the following description when read in conjunction with the accompanying drawings wherein:

FIG. 5 is a cross-sectional view taken on line 5—5 of FIG. 3;

Figure 8:
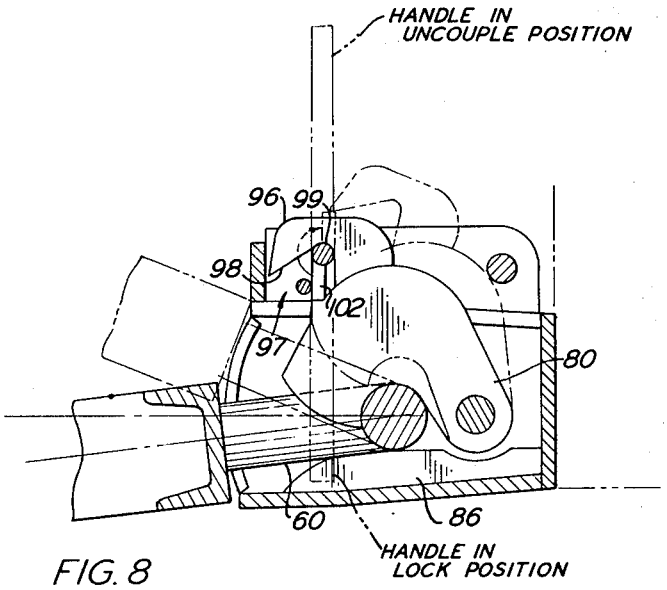
Figure 9:
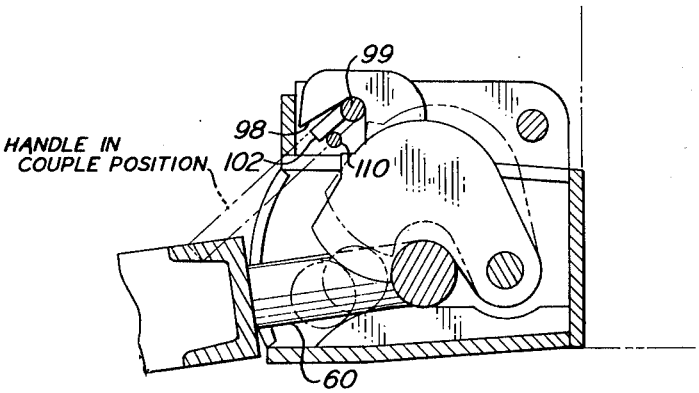

FIGS. 6 and 7 are cross-sectional views taken on lines 6—6 and 7—7 of FIG. 5;

FIG. 8 is a cross-sectional view similar to FIG. 5 but showing the assembly in locked position and in phantom in an uncoupled position; and, FIG. 9 is a cross-sectional view similar to FIG. 8 but showing the various components of the assembly in their position during a coupling operation.

PREFERRED EMBODIMENT

Figure 1:
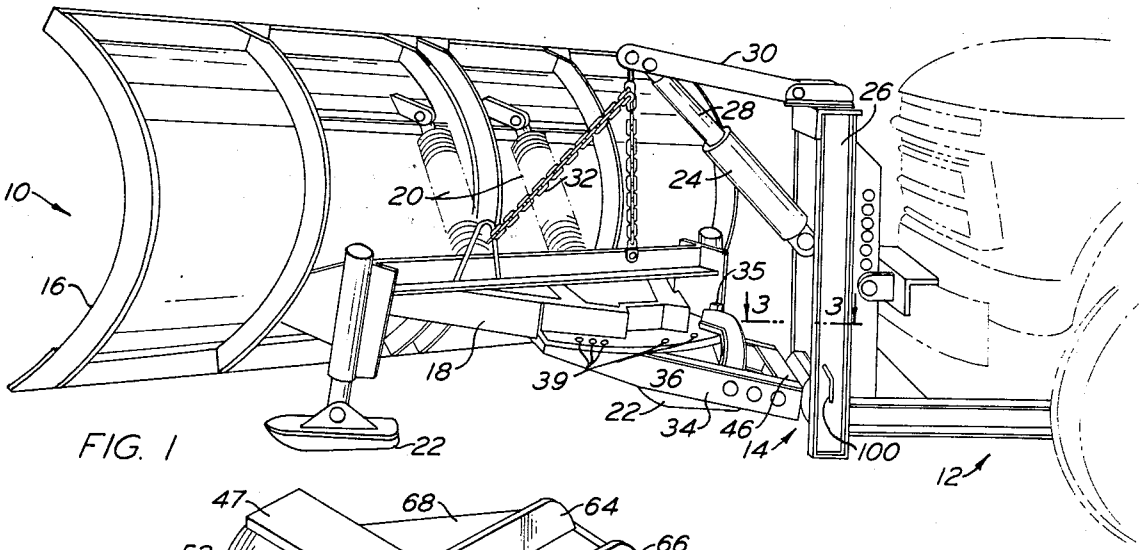
FIG. 1 is a pictorial view showing a typical plow assembly on which the coupling device of the subject invention is particularly useful.

Referring more particularly to FIG. 1, there is shown a relatively conventional snow plow assembly 10 which is connected to a truck or similar vehicle 12 by the improved coupling assembly 14. The plow assembly 10, as previously mentioned, is relatively conventional in construction and includes a standard blade 16 carried by a support frame 18. The blade is spring mounted to the frame 18 by springs 20 so that it can undergo some forward tilting should the lower edge of the blade encounter an obstacle. This structure is functionally similar to known force relief devices and will not be described in detail as its operation will be obvious to those having ordinary skill in the art from viewing the drawings. In the embodiment under consideration, frame 18 is also provided with slide shoes 22 which are adjustably mounted from the frame 18 in conventional manner.

As shown, the blade assembly is adapted to be raised and lowered through a hydraulic cylinder 24 which extends from a vertical, vehicle mounted support frame 26. The piston rod 28 of the cylinder 24 is pivotally connected to a lever 30 which extends outwardly from the upper end of the frame 26. A chain or the like 32 extends downwardly from the outer end of the arm 30 into engagement with the frame 18. In addition to its lifting function for the plow assembly, the chain 32 also limits the downward deflection of the end of the blade 16 relative to the arm 30.

The frame 18 is mounted on a pusher bar assembly 34 allowing it to be adjusted about a vertical axis to permit the angle of the blade to be varied. A pin 35 extends through a bracket 36 and plate 37 to lock the assembly 34 in place. Holes 39 illustrate the various allowable adjustments of the bracket 36 to orient the blade 16.

As can be appreciated, the connection between the pusher bar assembly 34 and the support frame 26 must be such as to allow free up and down pivoting movement of the pusher bar assembly at the connection. Raising and lowering of the blade must be permitted without disconnecting the blade from the truck. Similarly, there must be free lateral tilting of the assembly relative to the center line of the support frame 26 so that the blade can closely rise and fall with the crown of the road and otherwise shift for various slight elevational changes in the road contour. It is inherent in the structure that if the right hand side of the blade is lifted the left hand side will drop. This is because the allowable tilting movement pivots about a horizontal axis running approximately through the center line of support frame 26. Chain 32 limits the drop but not the left of one side or the other.

Figure 2:
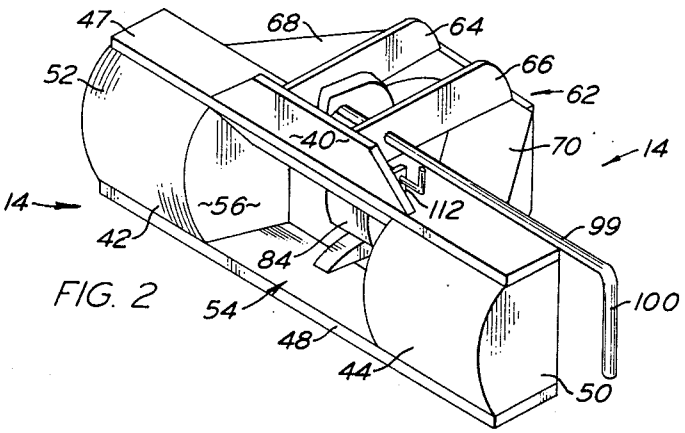
FIG. 2 is a pictorial view of the main component of the coupling assembly of the subject invention.
Figure 3:
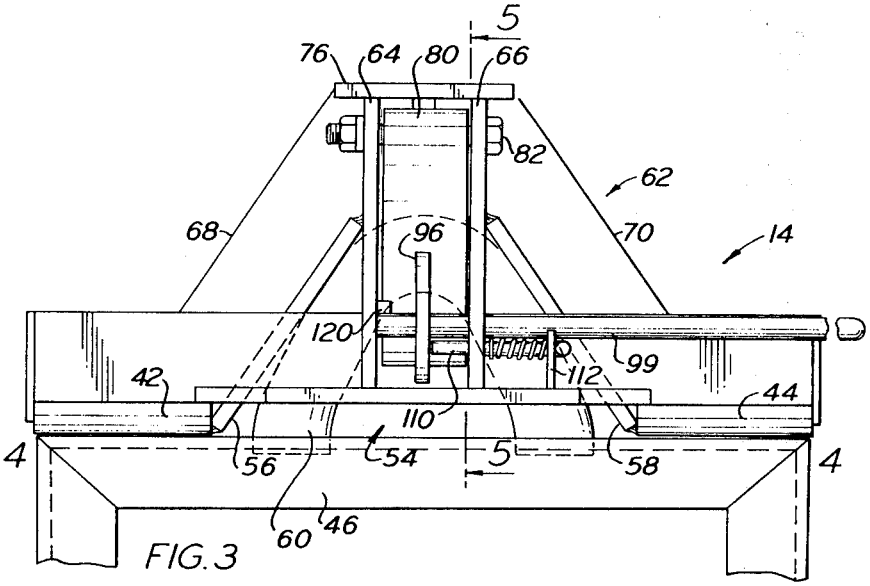
FIG. 3 is a partial cross-sectional view taken on line 3—3 of FIG. 1 and showing the coupling in engagement.
Figure 4:
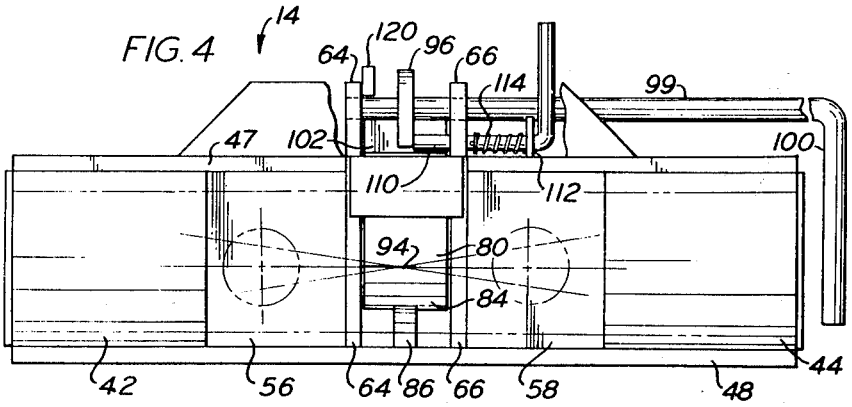
FIG. 4 is a cross-sectional view taken on the line 4—4 of FIG. 3.

In the subject arrangement, this allowable pivoting and tilting is accomplished by an improved coupling assembly 14 which is shown in detail in FIGS. 2 through 9. Referring in particular to FIGS. 2 through 4, the coupling assembly 14 is shown as including a first housing assembly 40 which is formed from relatively heavy metal plate and includes a pair of forwardly facing curved pusher surfaces 42, 44. Surfaces 42, 44 are arranged to engage the transversely extending frame member 46 of the pusher bar assembly 34. The pusher surfaces 42, 44 are connected between an upper housing plate 47 and a lower housing plate 48. Suitable end plates 50, 52 are provided to close the ends of the assembly.

A recess 54 is formed between the pusher surfaces 42, 44 and extends inwardly therefrom. As best shown in FIGS. 2 through 4, the recess 54 includes a pair of inclined side walls 56, 58 which extend between the upper plate 47 and the lower plate 48. The two side walls define a somewhat V-shaped recess which serves to perform a lateral guide function for a loop member 60 which extends outwardly from the pusher bar 46 as shown in FIG. 3. The arrangement and configuration of the loop 60 will subsequently be described in detail. However, for the present, it should be noted that, a frame or hook support assembly 62 is associated with the recess 54. The assembly 62 includes a first pair of generally vertically extending, spaced apart parallel frame plates 64, 66. Inclined angle braces 68 and 70 extend behind the plates 56 and 58 in the manner shown in FIGS. 2 and 3. A rear plate 76 is welded or otherwise positively joined to the pairs of plates 68, 70 and 64, 66.

Pivotally mounted between the plates 64, 66 is the hook member 80 best shown in FIG. 5. Hook member 80 is mounted for pivotal movement about a pivot pin 82 having an axis which extends horizontally and generally parallel to the axis of the curved push surfaces 42, 44. The hook member 80 has an outwardly facing surface 84 which is contoured so that when the hook is in the down or latch position shown in FIG. 5, the surface 84 is inclined at a slight angle relative to the horizontal. Positioned immediately beneath the hook 80 is a relatively narrow guide plate or ridge 86 which is welded or otherwise positively joined centrally in the recess 54 to the bottom plate 48 and the rear plate 76. The forward end of the guide plate 86 is contoured such that it forms, in combination with the surface 84 of hook 80, an outwardly flaring guide mouth 90. Immediately behind the outwardly facing surface 84, the hook has a downwardly open recess 92 which is contoured so as to closely receive the loop 60.

FIGS. 6 and 7 show the contour of the surfaces defining the recess 92. As shown, in the left-hand or forward portion of the recess 92, the hook has a relatively smooth rounded contour which gradually merges into the flatter, slightly inclined contour shown in FIG. 7.

It should be noted that the pivot point for the hook 80 is defined by the pin 82 and is located substantially in horizontal alignment with the final location of the apex 94 of the loop 60 in a coupled condition, see FIG. 4. Thus, as the forward portion of the loop enters the mouth 90 between the face 84 and the guide bar 86, a substantially horizontal component of force is required to cam the hook in the clockwise direction so that the loop can be received in the recess 92. As soon as the loop 60 moves beyond the face 84, the hook 80 will drop by gravity and insertion of the loop will be limited by frame member 46 encountering pusher faces 42, 44. With this arrangement it is easy for one man to connect a truck to a plow. The truck will move forward easily until it encounters faces 84 and 86. There will be some "give" in the forward movement until the frame 46 abuts the pusher faces 42, 44 where great resistance to forward movement will signal that the coupling is engaged.

Means are provided for locking the hook member in the coupled position. Additionally, means are provided for manually moving the hook to an open position for uncoupling. In the subject embodiment, these means include a cam plate member 96 which is welded or otherwise positively joined to the hook member 80 at its upper end. As best shown in FIGS. 3 through 5, the cam plate 96 includes a downwardly open recess 97, partially formed by an inclined cam face 98, which is located to receive a circular crank rod 99 which in turn is pivotally mounted from the vertical plates 64, 66. In the embodiment under consideration, the crank rod 99 extends horizontally above the housing 40 and has a crank handle 100 formed on the outer end. A lock plate 102 extends laterally from the crank rod 99 at a location between the vertical plates 64, 66. As best shown in FIG. 5, the lock plate 102 is sized so as to be closely received between the rod 99 and a latch surface 104 carried on a protuberance 106 of the hook 80. When the crank 99 is rotated to the position shown in FIGS. 3 through 5, the lock plate 102 holds the hook member in the down or coupled position. Movement of the lock plate 102 out of its lock position is prevented by a spring biased latch pin member 110 which, as best shown in FIGS. 3, 4, and 5 extends through the vertical plate 66 and a second mounting plate 112. The latch pin 110 is merely an L-shaped rod which is constantly biased to the left (as viewed in FIGS. 3 and 4) by the spring 114.

The overall operation of the coupling assembly can best be understood by reference to FIGS. 8 and 9. FIG. 8 shows the assembly fully coupled with the hook latched in its down or coupled position. Note that the loop 60 is tightly held between the hook and the guide plate 86. The latch plate 102 is locked in its lock position by the pin 110. To uncouple the asembly, the pin 110 is retracted and the shaft 99 rotated to move the lock plate 102 to its dotted line position of FIG. 8. Clockwise rotation of the lock plate 102 causes the plate to engage the inclined surface 98 of the cam plate 96 to rotate the hook 80 to a position wherein the loop 60 is released. A small stop plate or bar 120 (see FIGS. 3 and 4) limits the rotation of the latching lock plate 102 so that the hook is held in the dotted line position illustrated in FIG. 8. At this time, the loop 60 can readily be retracted, thereby releasing the plow assembly.

To place the assembly in condition for a coupling operation, the shaft 99 is merely rotated counter-clockwise to the dotted line position shown in FIG. 9. This allows the hook to return to its normal coupled position but, it will be noted that the lock plate 102 is prevented from moving into a lock position by the presence of the pin 110.

With the components in this relationship, the truck can be driven forward and the loop 60 will engage the mouth 90 between the hook and the guide bar 86. As the truck is driven forward, the loop causes the hook to be cammed in a clockwise direction (as viewed in FIG. 9). When the loop has passed completely under the hook to alignment with the recess 92, the hook falls into its coupled position. Because of the relationship of the surface 84 to the location of the pivot pin 82, a substantial force is required to cause the clockwise camming of the hook. After the loop has moved into position under the hook, the pin 110 is manually retracted and the lock plate 102 moved to the solid line position of FIG. 8. Release of the pin 110 then traps the lock plate 102 in its lock position.

Because of the shape of the loop 60, initial misalignment of the housing assembly and the loop can be substantial and still the cooperating inclined surfaces will cam the two into a mated position. Additionally, because of the cylindrical shape of the loop and the contour of the recess 92 of the hook, substantial movement of the plow support frame assembly can take place to allow the plow to adjust and closely follow road conditions. For example, FIG. 4 shows how the plow frame can tilt about apex 94 while the assembly is in a couple position. Similarly, the plow assembly can be raised and lowered as shown by the solid and dotted line positions of the loop 60 in FIG. 8. The raising and lowering is facilitated by the curved pusher surfaces 42, 44. In this way the horizontal pivot axis allows the flat frame member 46 to move vertically, relative to surfaces 42, 44 without moving appreciably closer to said surfaces and thereby binding and inhibiting free movement. Throughout this movement, the assembly is maintained coupled.

What is claimed is:

1. The combination of a snow plow and a truck, the truck including a female coupling member attached to its front, the snow plow including a male coupling member carried on its rear, means on said truck for raising and lowering the blade of the snow plow, means on the plow to facilitate limited universal angular movement thereof, the improvement comprising:

said female coupling member comprising a housing having a convex, forward force receiving surface having a substantially horizontal axis, said surface including a recess area therein;

latching hook means mounted within said recess area for pivotal movement about a substantially horizontal axis between opened and closed positions, said latching hook means including a latching surface;

said male coupling member comprising a rigid, generally planar frame having a loop protruding outwardly thereof extending into and retained in said recess area by latching engagement with said latching surface of said latching hook means, said force receiving surface of said female coupling member and said frame of said male coupling member being juxtaposed for transmitting force from one to the other, said latching surface and the cooperating engaging surface of said loop each being such to facilitate relative movement therebetween for permitting, raising, lowering, and tilting of said snow plow between different desired positions while said male coupling member is engaged with said female coupling member.

2. The improvement as defined in claim 1 wherein the vertical thickness of said loop is substantially less than the vertical depth of said recess area.

3. The improvement as defined in claim 1 wherein said loop is of generally circular cross-section and wherein said latching surface of said latching hook means is arcuately contoured to closely engage a portion of the circumference of said loop.

* * * * *